US011483900B2

(12) United States Patent
Yu et al.

(10) Patent No.: US 11,483,900 B2
(45) Date of Patent: Oct. 25, 2022

(54) CARBON FELT HEATING DEVICE AND METHOD OF MANUFACTURING THE SAME

(71) Applicant: EVERWELL TECHNOLOGY CO., LTD, Daejeon (KR)

(72) Inventors: Su Nam Yu, Daejeon (KR); Se Hwan Jeong, Daejeon (KR)

(73) Assignee: EVERWELLTECHNOLOGY CO., LTD, Daejeon (KR)

( * ) Notice: Subject to any disclaimer, the term of this patent is extended or adjusted under 35 U.S.C. 154(b) by 385 days.

(21) Appl. No.: 16/340,326

(22) PCT Filed: Mar. 29, 2018

(86) PCT No.: PCT/KR2018/003723

§ 371 (c)(1),
(2) Date: Apr. 8, 2019

(87) PCT Pub. No.: WO2019/066173

PCT Pub. Date: Apr. 4, 2019

(65) Prior Publication Data

US 2020/0045778 A1 Feb. 6, 2020

(30) Foreign Application Priority Data

Sep. 27, 2017 (KR) ..... 10-2017-0125545
Jan. 8, 2018 (KR) ..... 10-2018-0002463

(51) Int. Cl.
*H05B 3/14* (2006.01)
*H05B 3/04* (2006.01)
*H05B 3/34* (2006.01)

(52) U.S. Cl.
CPC ..... *H05B 3/145* (2013.01); *H05B 3/04* (2013.01); *H05B 3/342* (2013.01); *H05B 2203/003* (2013.01)

(58) Field of Classification Search
CPC ..... H05B 3/145; H05B 3/04; H05B 3/342; H05B 3/48; H05B 2203/003;
(Continued)

(56) References Cited

U.S. PATENT DOCUMENTS 3,657,516 A * 4/1972 Fujihara ..... F24D 13/02 392/435
6,483,087 B2 * 11/2002 Gardner ..... B32B 17/04 219/545
(Continued)

FOREIGN PATENT DOCUMENTS

CN 105169203 A 12/2015
JP 63016594 A 1/1988
(Continued)

OTHER PUBLICATIONS

Longquan Yu et al., "Effects of Some Chinese Spices on Body Weights, Plasma Lipids, Lipid Peroxides, and Glucose, and Liver Lipids in Mice", Food Sci. Technol. Res., 2007, pp. 155-161, vol. 13, No. 2.

*Primary Examiner* — Shawntina T Fuqua
(74) *Attorney, Agent, or Firm* — Rabin & Berdo, P.C.

(57) ABSTRACT

A carbon felt heating device is disclosed. The carbon felt heating device includes a carbon felt unit adapted to radiate heat upon supply of power, and power-connecting portions, which are provided at two ends of the carbon felt unit so as to electrically connect the carbon felt unit to a power source, wherein at least some of voids in the carbon felt unit are filled with resin or polymer.

14 Claims, 9 Drawing Sheets

(58) Field of Classification Search
CPC .... H05B 2203/034; H05B 3/146; H05B 3/18; H05B 3/20; H05B 3/22; H05B 3/28; H05B 3/06; H05B 3/14; H05B 3/40; H05B 3/03; H05B 3/34; H05B 3/64; H05B 2203/004; H05B 2203/007; H05B 2203/012; H05B 2203/002; H05B 1/0294; A01K 1/0254; A01K 1/029; A45F 3/04; A45F 2003/003; A45F 2004/003; A45C 13/262; A45C 2013/265
See application file for complete search history.

(56) References Cited

U.S. PATENT DOCUMENTS

| | | | | |
|---|---|---|---|---|
| 6,501,056 | B1 | 12/2002 | Hirohata et al. | |
| 6,949,727 | B2 | 9/2005 | Park | |
| 2011/0220634 | A1* | 9/2011 | Yeh | A43B 17/00 219/482 |
| 2014/0151353 | A1* | 6/2014 | Steinwandel | H05B 3/145 219/202 |
| 2016/0190736 | A1* | 6/2016 | Chun | H01R 13/6205 439/39 |

FOREIGN PATENT DOCUMENTS

| | | | | |
|---|---|---|---|---|
| JP | 01186581 | A | 7/1989 | |
| JP | 10055877 | A | 2/1998 | |
| JP | H10-055877 | A | 2/1998 | |
| JP | 2001525104 | A | 12/2001 | |
| JP | 2004209203 | A | 7/2004 | |
| JP | 2008171652 | A | 7/2008 | |
| JP | 2014507046 | A | 3/2014 | |
| JP | 2014204539 | A | 10/2014 | |
| KR | 10-2001-0071179 | | 7/2001 | |
| KR | 1020010071179 | A | 7/2001 | |
| KR | 1020030017584 | A | 3/2003 | |
| KR | 10-2004-0092043 | A | 11/2004 | |
| KR | 1020040092043 | A | 11/2004 | |
| KR | 100491225 | B1 | 5/2005 | |
| KR | 10-2009-0097264 | A | 9/2009 | |
| KR | 1020090097264 | A | 9/2009 | |
| KR | 1020120100237 | A | 9/2012 | |
| KR | 101754924 | B1 | 7/2017 | |
| KR | 10-1754924 | B1 | 8/2017 | |
| KR | 2064592 | B1 * | 1/2020 | H05B 3/14 |

* cited by examiner

ZONES OF CARBON FELT UNIT

| | | | | NO. 1 | 0.32A | | NO. 2 | 0.34A | | NO. 3 | 0.34A | | NO. 4 | 0.36A | |
|---|---|---|---|---|---|---|---|---|---|---|---|---|---|---|---|
| UPPER | a | | g | 43 ℃ | | 41.5 | 45 | | 43 | 42 | | 38 | 41 | | 44 |
| INTERMEDIATE | b | | f | 42 | | 42 | 42.5 | | 43 | 41 | | 43.5 | 43.5 | | 45 |
| LOWER | c | d | e | 43.5 | 30 | 44.5 | 42.3 | 36.3 | 45.5 | 43 | 36.5 | 43.5 | 45 | 36.5 | 47 |
| AVERAGE TEMPERATURE | | | | 42.8 | 30.0 | 42.7 | 43.3 | 36.3 | 43.8 | 42.0 | 36.5 | 43.7 | 43.2 | 36.5 | 45.3 |
| LENGTH | L1 | L5 | L2 | 150 | 10 | 150 | 150 | 10 | 150 | 150 | 10 | 150 | 150 | 10 | 150 |

CONVENTIONAL CARBON FELT UNIT

| | | | | NO. 1 | 0.29A | | NO. 2 | 0.31A | | NO. 3 | 0.31A | | NO. 4 | 0.34A | |
|---|---|---|---|---|---|---|---|---|---|---|---|---|---|---|---|
| UPPER | a | | g | 44.5 ℃ | | 46 | 47 | | 47.5 | 47 | | 47.5 | 46 | | 46 |
| INTERMEDIATE | b | | f | 45.5 | | 46 | 45.5 | | 47 | 45.5 | | 46.5 | 47 | | 47 |
| LOWER | c | d | e | 46 | 39.3 | 47.1 | 45 | 41 | 48.6 | 45 | 41 | 46 | 48 | 42 | 47 |
| AVERAGE TEMPERATURE | | | | 45.3 | 39.3 | 46.4 | 45.8 | 41.0 | 47.7 | 45.8 | 41.0 | 46.7 | 47.0 | 42.0 | 46.7 |
| LENGTH | L1 | L5 | L2 | 150 | 10 | 150 | 150 | 10 | 150 | 150 | 10 | 150 | 150 | 10 | 150 |

INVENTIVE CARBON FELT UNIT

CARBON FELT HEATING DEVICE AND METHOD OF MANUFACTURING THE SAME

BACKGROUND OF THE INVENTION

Field of the Invention

The present invention relates to a carbon felt heating device and a method of manufacturing the same.

Description of the Related Art

Generally, heating elements are roughly classified into a wire heating element and a sheet heating element.

The wire heating element, which is a heating body such as coil manufactured by a Nichrome wire and generates heat when current is supplied to the heating body, is being applied to various products such as mattresses and heating vests.

In the case of the wire heating element, a temperature deviation on a heating surface is locally increased because the distance between heating wires is relatively great, and there is a great risk of occurrence of overheating and thus fire disaster upon application of over current. Furthermore, there is also a problem whereby connection of a coil is easily broken.

The sheet heating element is classified into a metal heating element, which utilizes a metal such as Nichrome, copper-nickel alloy and aluminum, and a non-metal heating element, which utilizes a carbon material.

The metal heating element utilizes a metal heating body such as a Nichrome wire, an iron wire, a nickel wire and a silver-plated copper wire. The metal heating element has a risk of occurrence of fire disaster due to overheating in the event of application of over current and a problem whereby the metal heating element is easily cut when bending stress is repeatedly applied thereto. In addition, the metal heating element has a problem of relatively great electricity consumption.

The non-metal heating element utilizes a heating body constituted by carbon fibers in order to overcome the problems associated with the wire heating element and the sheet heating element composed of the metal heating body. The non-metal heating element is manufactured in such a way as to coat surfaces of fibers or film with carbon through deposition or printing or to knit carbon yarns as weft yarns, which are spaced apart from each other at regular intervals, with conductive yarns as warp yarns, which are spaced apart from each other.

Since carbon, which is one of the components of ceramic, has a highly excellent electric conductivity and withstands high temperature, the carbon is extensively used as a heating body.

A heating body, which utilizes carbon fibers, is configured such that a plurality of carbon fibers are arranged in a certain pattern and power lines are brought into contact with both ends of the carbon fibers and connected thereto, whereby the carbon fibers generate heat due to power applied thereto through the power lines.

A carbon-fiber thread, which is produced by heating and carbonizing organic fibers in inert gas atmosphere, generates heat upon application of electric power. Various processes of producing the carbon-fiber thread are known to in the art. Among the processes, there are a process of making carbon powder including various inorganic mineral components into paste and applying the paste to general multifilament fiber threads, a process of melting carbon, tungsten, manganese and stainless steel at a high temperature and spinning the molten material into threads, and a process of carbonizing polyacrylonitrile fibers.

The carbon fiber heating element, which is constituted by carbon fibers or carbon fiber threads, has advantages of low power consumption, warm and comfortable feeling owing to sheet heating and high rate of temperature increase, compared to a metal heating element. In the heating element, which is constituted by such carbon fibers, the service life of the heating element is determined by durability and adhesive stability of power lines disposed at both ends of the carbon fibers.

Since the heating element, which utilizes carbon fibers as heating source, does not cause air pollution and sound noise and radiates far infrared rays beneficial to human body in addition to sanitary benefit, the heating element is extensively used in hyperthermia therapy, healthy sauna, clothes, bedclothes, constructive heating material, prevention of freezing and accumulation of snow on a road, dry of farm and marine products, livestock barn for pig and poultry, insulating tape for pipes of a chemical factory and a gas-carrying vessel and heating material for future residential house.

Because the above-mentioned heating elements are manufactured through a complicated process, there are problems of complicated structure, increase in manufacturing cost and increase in installation space of the heating elements.

Graphite or carbon composite materials are composed of the same material component but have different physical properties. Among these, ceramic containing carbon, for example, silicon carbide (SiC) or the like is used a heating element.

Such a carbon heating element is used as a heating element for high-temperature vacuum heat treating furnaces or ingot growing furnaces in industrial facilities. In order to generate a large amount of heat, the carbon heating element is configured to have a complex structure so as to increase electric resistance.

In addition, because the carbon heating element has rigidity and no flexibility due to its inherent material properties, the carbon heating element has to be subjected to a milling process or a grinding process in order to be made into a shape suitable for the intended use, thereby making it difficult to produce in large volume and increasing a manufacturing cost.

When an electromagnetic wave radiated due to a natural phenomenon is absorbed into an object, the electromagnetic wave is converted into energy capable of heating the object. In this case, the energy is called radiant heat.

Specifically, when an electromagnetic wave radiated from an object is directly absorbed into another object, the electromagnetic wave is converted into energy creating heat. Since the radiant heat is directly transferred without a phenomenon such as convection or conduction, the heat is instantaneously transferred.

Consequently, when a heating body, which generates heat due to electric resistance, is configured to have one of various shapes such as a linear shape, a zigzag shape and a spiral shape such that adjacent zones thereof are oriented so as to face each other, heat of a certain temperature or higher is generated between the adjacent zones.

SUMMARY OF THE INVENTION

Therefore, the present invention has been made in view of the above problems, and it is an object of the present invention to provide a sheet heating element, which is made of a relatively light carbon felt capable of embodying the principle and structure of generating radiant heat, which is applicable to various fields, which exhibits uniform heat distribution over a wide area, and which is able to accomplish the object of the heating element even by low power consumption.

It is another object of the present invention to provide a sheet heating element, which is made of a carbon felt capable of providing effects of radiating far infrared rays so as to offer an excellent heating effect of radiating heat in all directions and an effect beneficial to a human body.

Objects of the present invention are not limited to the above-mentioned objects, and other objects, which are not mentioned, will be apparently understood by those skilled in the art from the following disclosure.

In accordance with an aspect of the present invention, the above and other objects can be accomplished by the provision of a carbon felt heating device including a carbon felt unit adapted to radiate heat upon supply of power, and power-connecting portions, which are provided at two ends of the carbon felt unit so as to electrically connect the carbon felt unit to a power source, wherein at least some of voids in the carbon felt unit are filled with resin or polymer.

As the number of voids filled with the resin or polymer is increased, the carbon felt unit becomes difficult to break.

The carbon felt heating device may further include a housing having a hole or groove corresponding to a shape of the carbon felt unit so as to allow the carbon felt unit to be fitted into the hole or groove in the housing.

A waterproofing insulation layer may be formed both on a surface of the carbon felt unit that is exposed to the outside of the housing and on an outer surface of the housing.

The carbon felt heating device may further include a base member disposed on the waterproofing insulation layer.

The carbon felt unit and the power-connecting portions may be surrounded by a waterproofing insulation material.

The carbon felt heating device may further include a battery unit electrically connected to the power-connecting portions so as to supply power to the carbon felt unit.

The carbon felt heating device may further include a wireless charging module for charging the battery unit.

The carbon felt heating device may further include a first magnet connector electrically connected to the battery unit, the first magnet connector being detachably attached to a second magnet connector electrically connected to a charging power so as to supply the charging power to the battery unit.

The carbon felt unit may have a hole.

The carbon felt unit may include a plurality of unit carbon felts, the plurality of unit carbon felts being connected to the power source in series or in parallel.

In accordance with another aspect of the present invention, there is provided a method of manufacturing a carbon felt heating device including impregnating a carbon felt with resin solution or polymer solution such that voids in the carbon felt is filled with the resin or polymer solution, drying the carbon felt with the voids being filled with the resin or polymer solution, and connecting power-connecting portions to two ends of the carbon felt filled with the resin or polymer.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Reference will now be made in detail to the preferred embodiments of the present invention, examples of which are illustrated in the accompanying drawings. Those skilled in the art will easily appreciate that the accompanying drawings are given only for more easy understanding of the gist of the present invention and the protection scope of the invention is not limited to the accompanying drawings. The terminology used in the present disclosure is merely for the purpose of describing particular embodiments only and is not intended to limit the present invention. A singular representation may include a plural representation unless context clearly indicates otherwise.

The terms such as "includes" or "has" used herein should be considered as indicating the presence of several features, numbers, steps, operations, elements, components or combinations thereof disclosed in the specification, and it should be understood that the presence or addition of one or more other features, numbers, steps, operations, elements, components or combinations thereof may likewise be utilized.

Figure 1:
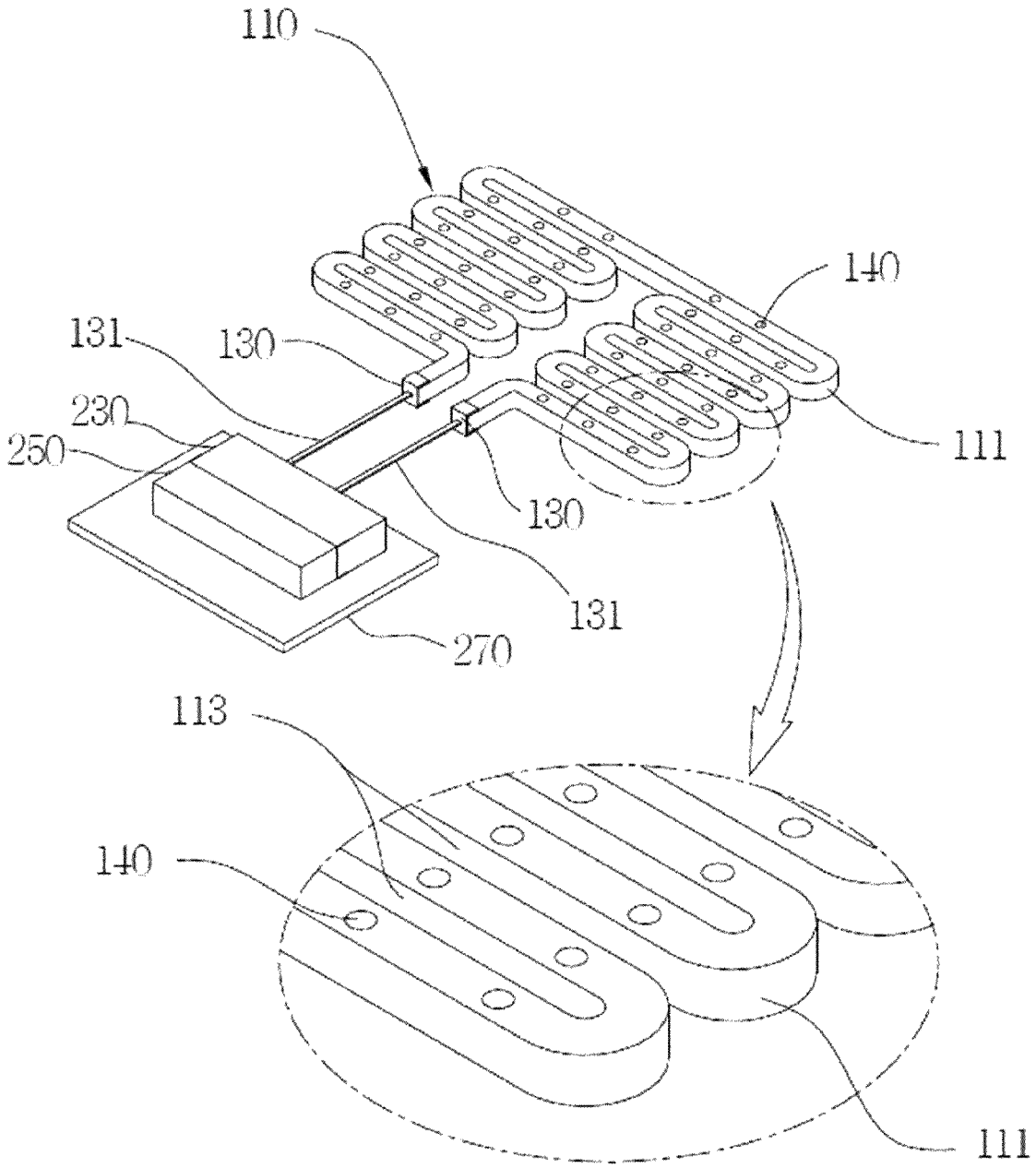
FIGS. 1 to 3 are views illustrating a carbon felt heating device according to an embodiment of the present invention.
Figure 2:
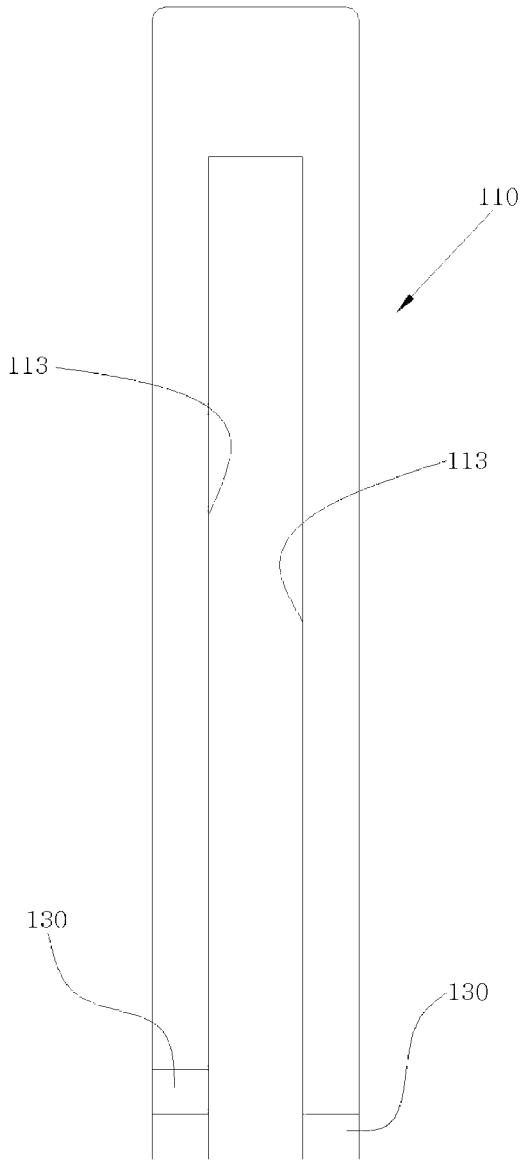
Figure 3:
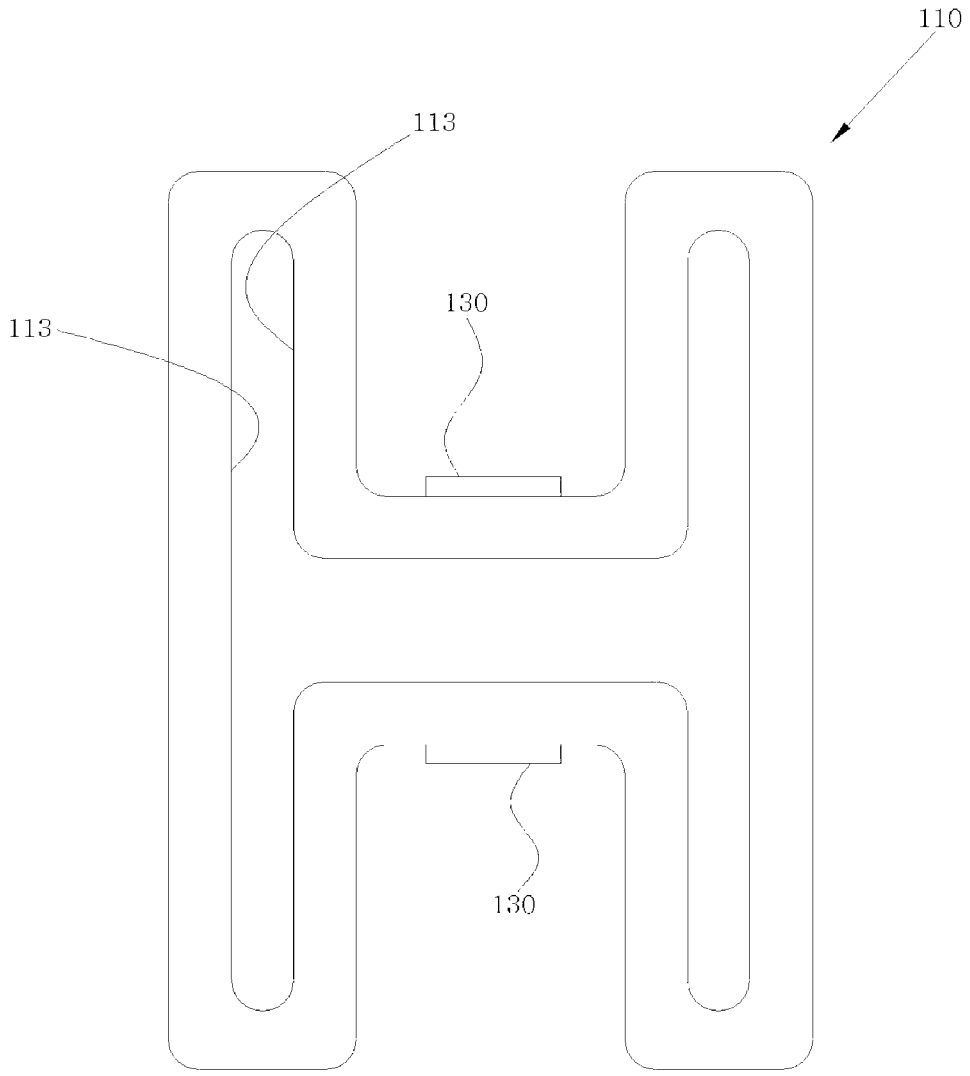

FIGS. 1 to 3 illustrate a carbon felt heating device according to an embodiment of the present invention. As illustrated in FIGS. 1 to 3, the carbon felt heating device according to the embodiment of the present invention includes a carbon felt unit 110 and power-connecting portions 130.

The carbon felt unit 110 generates heat upon supply of power. The carbon felt unit 110 may be prepared in such a way as to cut carbon fibers into a proper length and to subject the cut carbon fibers to carding and needling processes.

The power-connecting portions 130 are provided at two ends of the carbon felt unit 110 so as to be connected to a power source. The power-connecting portions 130 may be made of a material, such as copper or aluminum, which is mountable to the carbon felt unit 110 and has electrical conductivity. As illustrated in FIG. 1, conductive wires 131 for supply of power may be connected to the power-connecting portions 130.

The power-connecting portions 130 may be electrically connected to a power source via a base board (not shown). Here, the base board may be a printed circuit board (PCB) or a flexible printed circuit board (FPCB) without being limited thereto.

Power supply terminals (not shown) may be connected to the conductive wires 131 or the base board. The power supply terminals, which are intended to be connected to a battery unit 230, may be USB connection terminals without being limited thereto.

The carbon felt unit 110 includes voids therein, and is apt to be broken due to inherent brittle property thereof even by a low force. In order to prevent the breakage, at least some of voids in the carbon felt unit 110 of the carbon felt heating device according to the embodiment of the present invention may be filled with resin or polymer.

Since the voids in the carbon felt unit 110 are filled with resin or polymer, the brittleness of the carbon felt unit 110 is reduced and handling property thereof is improved. In addition, the carbon felt unit 110 may be configured to have various shapes and thicknesses.

As illustrated in FIG. 1, the carbon felt unit 110 may include, for example, a plurality of curved portions 111 so as to be corrugated. Accordingly, the carbon felt unit 110 may have a shape which is concave at a side thereof, as illustrated in FIG. 2, or may have a closed loop shape, as illustrated in FIG. 3. FIG. 3 shows an example in which the carbon felt unit 110 is made of a rigid felt, which is applicable at a higher temperature than a soft felt.

When a soft felt is disposed in a high-temperature vacuum furnace which is filled with methane gas, hydrogen component (H) in the methane gas is burned away, and the soft felt is impregnated with carbon component (C) in the methane gas, thereby producing the rigid felt.

The shape of the carbon felt unit 110 is limited to the shapes shown in FIGS. 1 to 3.

Since the carbon felt unit 110 is able to be configured to have various shapes, the carbon felt unit 110 may be bent so as to cause the lateral surfaces 113 thereof to face each other.

Figure 4:
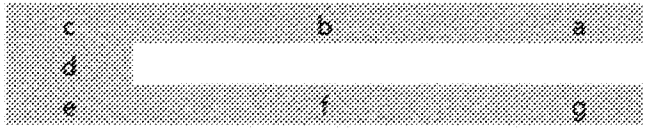
FIG. 4 is a view illustrating temperature variation of a carbon felt unit depending on presence of resin or polymer.

FIG. 4 illustrates temperature variation of the carbon felt unit 110 depending on presence of resin or polymer. The carbon felt unit 110 was divided into zone a to zone g, and temperatures of the respective zones of the carbon felt unit 110 were measured with supply of power. A voltage of 5 V was applied to the carbon felt unit 110, and current of the carbon felt unit 110 was measured with application of voltage. Under these conditions, temperatures and currents of the respective zones of the carbon felt unit 110 were measured four times.

As illustrated in FIG. 4, it is noted that the carbon felt unit 110 according to the embodiment of the present invention exhibits higher temperature and smaller current consumption, compared to a conventional carbon felt unit 110. From these experimental results, it is noted that the carbon felt 110 according to the embodiment of the present invention generates a larger amount of heat by lower power consumption compared to a conventional carbon felt unit 110 voids of which are not filled with resin or polymer.

As the number of voids filled with resin or polymer is increased, the carbon felt unit 110 becomes difficult to break. Accordingly, it is possible to provide the carbon felt unit 110 having durability of a desired level by controlling an amount of resin or polymer depending on a property of a product or apparatus to which the carbon felt unit 110 is mounted or a design condition of the carbon felt unit 110.

In addition, since the extent of flexibility of the carbon felt unit 110 may be changed depending on an amount of resin or polymer, it is possible to provide the carbon felt unit 110 having flexibility appropriate to a property of a product or apparatus or a design condition.

Figure 5A:
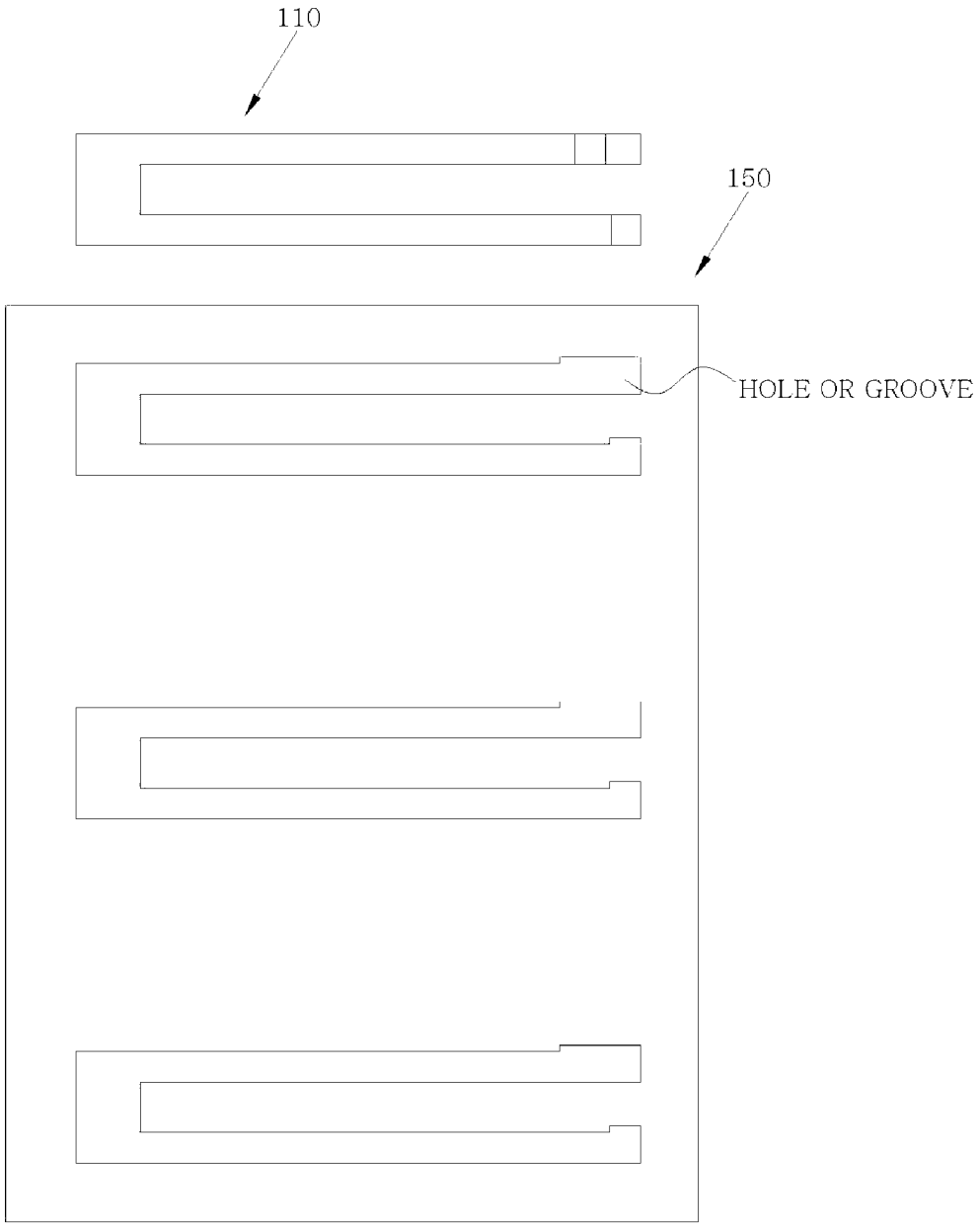
FIGS. 5A and 5B are views illustrating examples of the carbon felt unit and a housing of the carbon felt heating device according to the embodiment of the present invention.
Figure 5B:
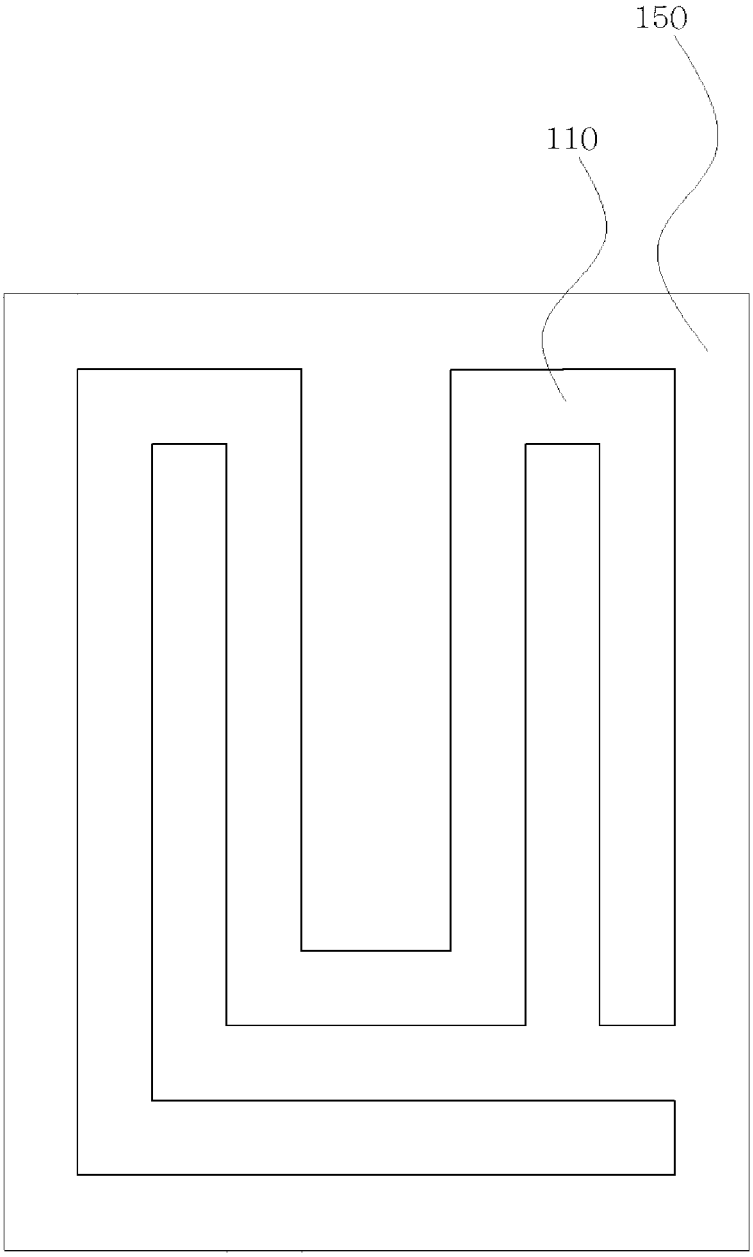

FIGS. 5A and 5B illustrate the carbon felt unit 110 and a housing of the carbon felt heating device according to the embodiment of the present invention. As illustrated in FIGS. 5A and 5B, the carbon felt heating device according to the embodiment of the present invention may further include the housing 150, which has a hole or groove corresponding to the shape of the carbon felt unit 110 so as to allow the carbon felt unit 110 to be fitted thereinto. Here, the housing 150 may be made of ethylene vinyl acetate (EVA), a urethane form, a sponge or the like without being limited thereto.

The housing 150 may electrically insulate the carbon felt unit 110 from the ambient environment. Since the carbon felt unit 110, which is filled with resin or polymer, has low brittleness and high flexibility as described above, the carbon felt unit 110 may be configured into various shapes. Accordingly, when the carbon felt unit 110 is bent so as to cause the lateral surfaces 113 thereof to face each other, it may be difficult to apply an insulating material to the lateral surfaces 113.

Since the housing 150 has the hole or groove corresponding to the shape of the carbon felt unit 110, which may have various shapes, and the lateral surfaces of the housing 150 are brought into contact with the lateral surfaces 113 of the carbon felt unit 110, the carbon felt unit 110 may be insulated.

As illustrated in FIG. 5B, because a portion of the surface of the carbon felt unit 110 and the outer surface of the housing 150 may be exposed to the outside even when the carbon felt unit 110 is fitted into the housing 150, insulation property and waterproofing property of the heating device may be deteriorated.

Figure 6:
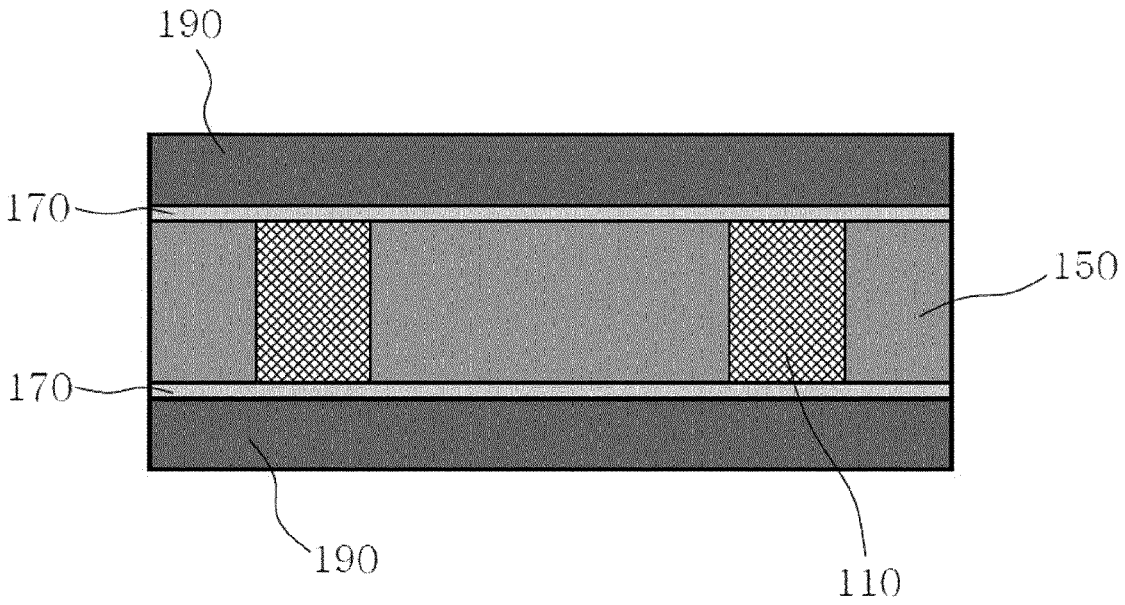
FIG. 6 is a cross-sectional view illustrating the housing and the carbon felt unit on which is provided with a waterproofing insulation member and a base member.

In order to prevent the deterioration, the surface of the carbon felt unit 110 that is exposed to the outside of the housing 150 and the outer surface of the housing 150 may be provided with waterproofing insulation layer 170, as illustrated in FIG. 6. Because the waterproofing insulation layer 170 may be weak to external pressure or ambient environment, a base member 190 may be disposed on the waterproofing insulation layer 170. The waterproofing insulation layer 170 may be an insulation tape without being limited thereto. The waterproofing insulation layer 170 may be made of a flame-retardant material in order to prevent fire disaster attributable to increase in temperature.

The base member 190 may be made of non-woven cloth or insulative film such as polyurethane (PU), thermoplastic polyurethane (TPU) or the like without being limited thereto. As the heat conductivity of the non-woven cloth of the base member 190 is increased or as the thickness of the non-woven cloth is reduced, heat generated from the heating device can be efficiently transferred.

Although the waterproofing insulation layer 170 and the base member 190 may be prepared through separate processes, the waterproofing insulation layer 170 may be formed on the housing 150 and the carbon felt unit 110 by previously forming the waterproofing insulation layer 170 on the base member 190 and attaching the base member 190 to the housing 150 and the carbon felt unit 110.

Although FIG. 6 shows the carbon felt unit 110 which is provided on both sides thereof with the base members 190, the carbon felt unit 110 may be provided on one side thereof with the base member 190 and on the other side thereof with a heat insulation member (not shown) in place of the base member 190. Since the heat insulation member blocks radiation of heat from the carbon felt unit 110, heat generated from the carbon felt unit 110 may be radiated to the outside via the base member 190 formed on the one side of the carbon felt unit 110. Accordingly, it is possible to control the direction in which the heat generated from the carbon felt unit 110 is radiated, using the heat insulation member. In addition, by attaching a heart reflector such as thin silver film (not shown) to the heat insulation member, it is possible to reflect the heat generated from the carbon felt unit 110 in the one direction.

Figure 7:
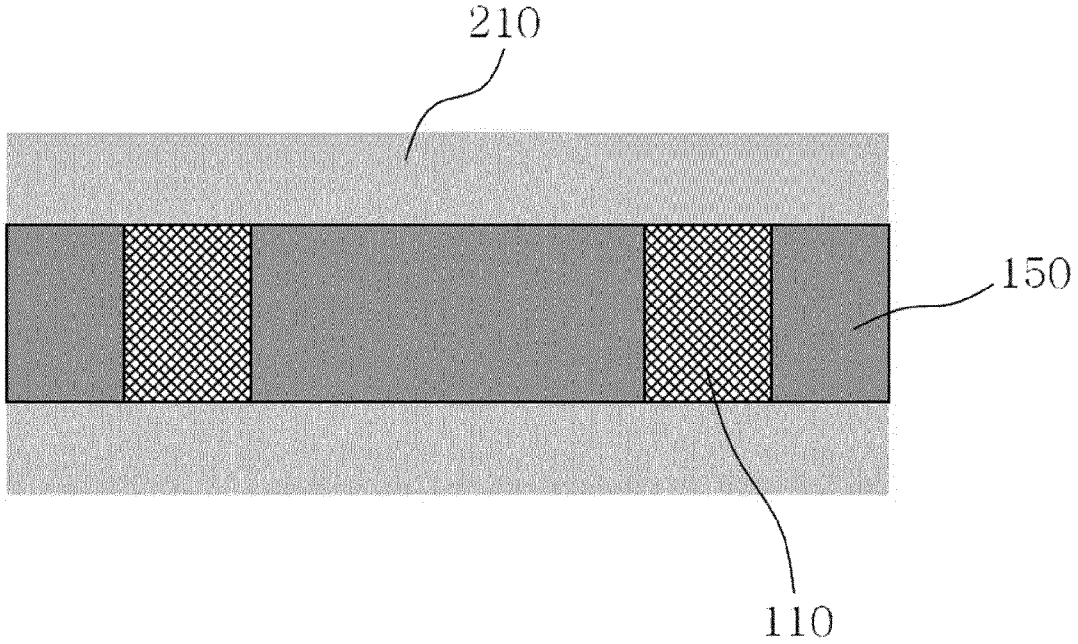
FIG. 7 is a cross-sectional view illustrating the housing and the carbon felt unit, which are surrounded by a waterproofing insulation material.
Figure 8:
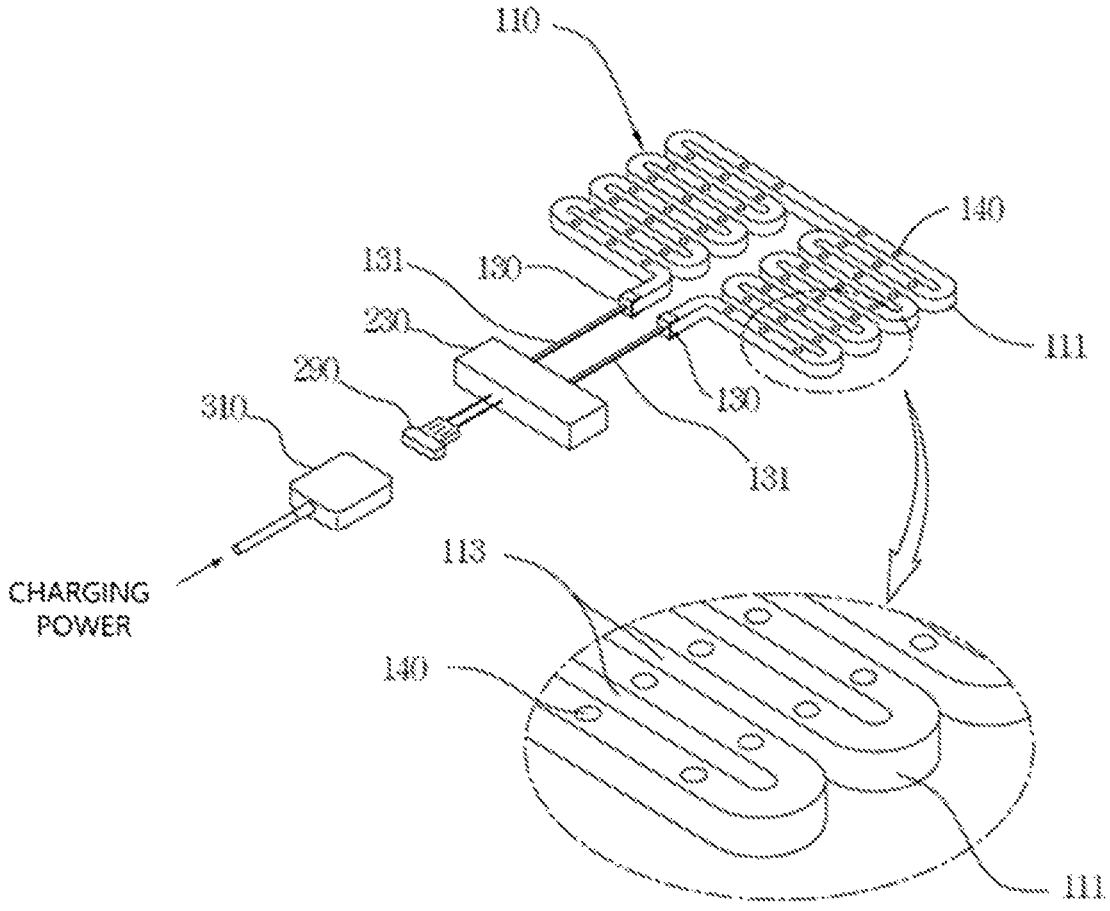
FIGS. 8 and 9 are views illustrating an embodiment of the carbon felt heating device according to the embodiment of the present invention.

Alternatively, the carbon felt unit 110 and the power-connecting portions 130 may be surrounded by a waterproofing insulation material 210, as illustrated in FIG. 7. The waterproofing insulation material 210 may be silicone, polyurethane or the like without being limited thereto.

The housing 150, into which the carbon felt unit 110 is fitted, and components provided on both sides of the housing 150 may be accommodated in a protective pouch (not shown). Here, the components may be the waterproofing insulation layer 170, the base member 190, the heat insulation member, the heat reflector, the waterproofing insulation material 210 and the like.

The protective pouch is intended to protect the items accommodated in the protective pouch from external moisture or water or external impact. The protective pouch may be made of TPU without being limited thereto.

The internal space of the protective pouch may be compartmented into two or more subspaces. The respective subspaces may accommodate the housing 150 into which the carbon felt unit 110 is fitted and the components provided on the both sides of the housing 150. Since the protective pouch can be folded about the boundary between the subspaces, the carbon felt heating device may be applicable to products such as clothes, which are usually folded.

As illustrated in FIG. 1, the carbon felt heating device according to the embodiment of the present invention may further include a battery unit 230, which is electrically connected to the power-connecting portions 130 so as to supply power to the carbon felt unit 110. The battery unit 230 may be charged when necessary, and may include an overcharge protection device (not shown) or a switching device (not shown) for allowing or interrupting supply of power.

As illustrated in FIG. 1, the carbon felt heating device according to the embodiment of the present invention may further include a wireless charging module 250 for charging the battery unit 230. The wireless charging module 250 may receive power, which is wirelessly supplied from a wireless charging pad 270, and may charge the battery unit 230.

Instead of the battery unit 230, a commercial AC power may be directly connected to the conductive wires 131 so as to supply the power to the carbon felt unit 110, or an AC/DC converter (not shown) may further be connected to the conductive wires 131 such that the commercial AC power is converted into a DC power and is supplied to the carbon felt unit 110.

The carbon felt heating device according to the embodiment of the present invention may further include a first magnet connector 290, which is electrically connected to the battery unit 230. The first magnet connector 290 may be detachably attached to a second magnet connector 310, which is electrically connected to the charged power so as to supply the charged power to the battery unit 230. The first magnet connector 290 and the second magnet connector 310 contain a magnetic material so as to be magnetically attached to each other.

As illustrated in FIGS. 1 to 8, holes 140 may be formed in the carbon felt unit 110.

Figure 9:
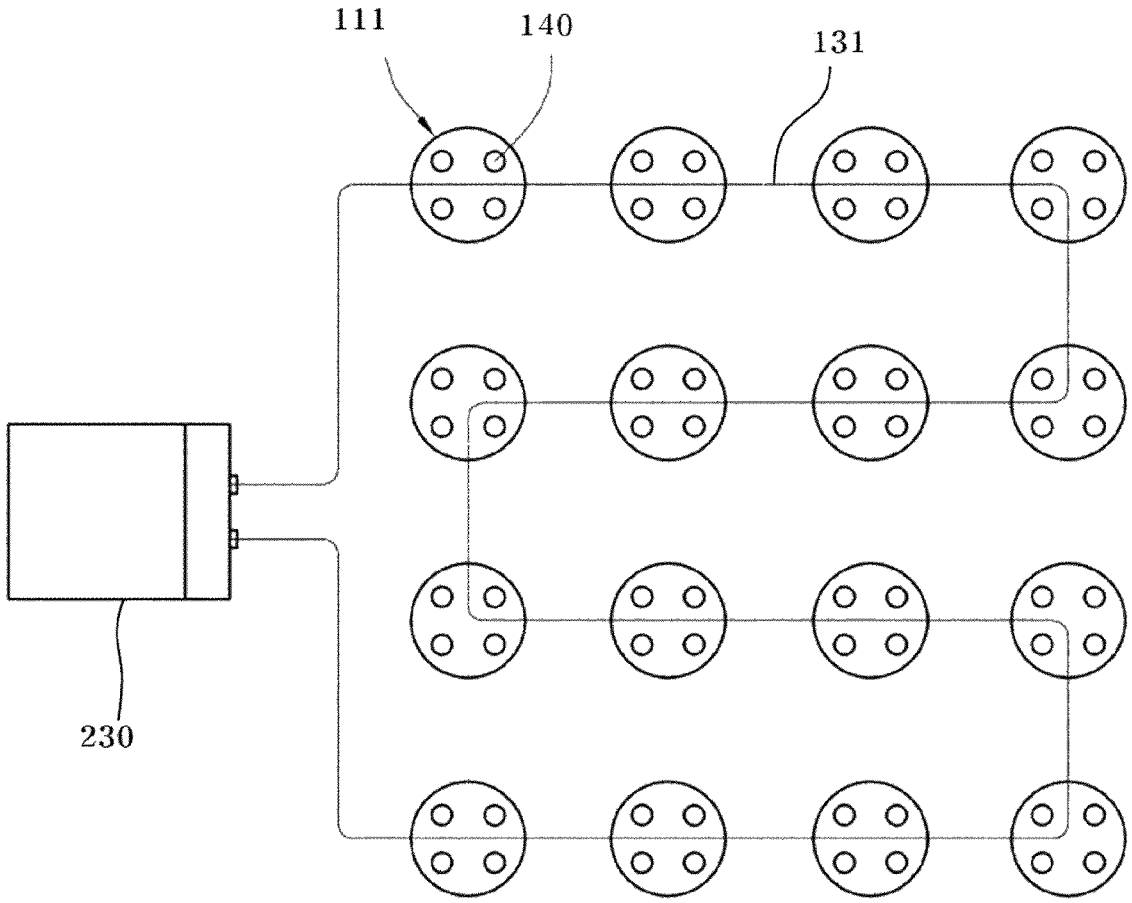

As illustrated in FIG. 9, the carbon felt unit 110 may include a plurality of unit carbon felts 111, which are connected to the power in series or in parallel.

A method of manufacturing the carbon felt heating device according to an embodiment of the present invention includes impregnating the carbon felt with resin solution or polymer solution such that voids in the carbon felt is filled with the solution, drying the carbon felt with the voids being filled with the resin or polymer solution, and connecting the power-connecting portions 130 to the two ends of the carbon felt filled with the resin or polymer.

The resin solution may be mixture of resin and solvent capable of dissolving the resin, and the polymer solution may be mixture of polymer and solvent capable of dissolving the polymer. For the stabilization of the solution, an additive substance may be added to the solution.

As is apparent from the above description, the carbon felt heating device according to the present invention has advantages of excellent processing property and portability because the heating device is made of a carbon felt having a light weight.

In addition, since principle and structure in which radiation heat and heat due to electric resistance is generated are applied to a relatively light carbon felt, heat can be uniformly distributed over a wide area and can be radiated in all directions, whereby the objects of the heating device can be implemented even by low power.

Furthermore, among a soft felt and a rigid felt, the soft felt is used when the resulting carbon felt heating device needs to be flexibly deformed, and the rigid felt is used when the resulting carbon felt heating device does not need to be deformed. Accordingly, since the carbon felt heating device can be manufactured so as to have a desired one of various shapes and designs, the heating device may be applied to various fields of application.

In addition, by virtue of a large amount of far infrared rays emitted from the carbon felt, there are a lots of benefits of excellent heating performance, activation of cellular tissues of a human body and improvement of metabolism.

Effects of the present invention are not limited to the above-mentioned effects, and effects, which are not mentioned above, will be understood by those skilled in the art from the above disclosure.

Although the embodiments of the invention have been described, those skilled in the art will appreciate that the present invention can be embodied in other specific forms other than the above-described embodiments within the spirit and scope of the present invention. The present embodiments should be therefore construed as being illustrative and not restrictive. Accordingly, the present invention may be variously modified within the spirit and scope of the present invention as defined by the appended claims without being limited to the above description.

What is claimed is:

1. A carbon felt heating device comprising:

a carbon felt unit having a plurality of voids and adapted to radiate heat upon supply of power;

power-connecting portions, which are provided at two ends of the carbon felt unit so as to electrically connect the carbon felt unit to a power source, a housing having a hole or groove corresponding to a shape of the carbon felt unit so as to allow the carbon felt unit to be fitted into the hole or groove in the housing, wherein at least some of voids in the carbon felt unit are filled with resin or polymer, and wherein a waterproofing insulation layer is formed both on a surface of the carbon felt unit that is exposed to the outside of the housing and on an outer surface of the housing.

2. The carbon felt heating device according to claim 1, wherein as a number of the at least some of the voids filled with the resin or polymer is increased, the carbon felt unit becomes difficult to break.

3. The carbon felt heating device according to claim 1, further comprising a base member disposed on the waterproofing insulation layer.

4. A carbon felt heating device comprising:

a carbon felt unit having a plurality of voids and adapted to radiate heat upon supply of power;

power-connecting portions, which are provided at two ends of the carbon felt unit so as to electrically connect the carbon felt unit to a power source; and a waterproofing insulation material contacting the carbon felt unit and the power-connecting portions from opposing sides of the carbon felt unit, wherein at least some of voids in the carbon felt unit are filled with resin or polymer.

5. A carbon felt heating device comprising:

a carbon felt unit having a plurality of voids and adapted to radiate heat upon supply of power;

power-connecting portions, which are provided at two ends of the carbon felt unit so as to electrically connect the carbon felt unit to a power source; and a battery unit electrically connected to the power-connecting portions so as to supply power to the carbon felt unit, wherein at least some of voids in the carbon felt unit are filled with resin or polymer.

6. The carbon felt heating device according to claim 5, further comprising a wireless charging module for charging the battery unit.

7. The carbon felt heating device according to claim 5, further comprising a first magnet connector electrically connected to the battery unit, the first magnet connector being detachably attached to a second magnet connector electrically connected to a charging power so as to supply the charging power to the battery unit.

8. A carbon felt heating device comprising:

a carbon felt unit having a plurality of voids and adapted to radiate heat upon supply of power; and power-connecting portions, which are provided at two ends of the carbon felt unit so as to electrically connect the carbon felt unit to a power source, wherein at least some of voids in the carbon felt unit are filled with resin or polymer, and wherein the carbon felt unit has a hole.

9. A carbon felt heating device comprising:

a carbon felt unit having a plurality of voids and adapted to radiate heat upon supply of power; and power-connecting portions, which are provided at two ends of the carbon felt unit so as to electrically connect the carbon felt unit to a power source, wherein at least some of voids in the carbon felt unit are filled with resin or polymer, and wherein the carbon felt unit includes a plurality of unit carbon felts, the plurality of unit carbon felts being connected to the power source in series or in parallel.

10. The carbon felt heating device according to claim 9, wherein the carbon felt unit is elongate and includes a plurality of 180-degree bends.

11. The carbon felt heating device according to claim 4, wherein the carbon felt unit is elongate and includes a plurality of 180-degree bends.

12. The carbon felt heating device according to claim 5, wherein the carbon felt unit is elongate and includes a plurality of 180-degree bends.

13. The carbon felt heating device according to claim 8, wherein the carbon felt unit is elongate and includes a plurality of 180-degree bends.

14. The carbon felt heating device according to claim 9, wherein the carbon felt unit is elongate and includes a plurality of 180-degree bends.

* * * * *